United States Patent [19]

Saeki et al.

[11] Patent Number: 4,981,769

[45] Date of Patent: Jan. 1, 1991

[54] LIGHT IMAGE FORMING MATERIAL

[75] Inventors: Keiso Saeki; Tosiaki Endo, both of Shizuoka, Japan

[73] Assignee: Fuji Photo Film Co., Ltd., Kanagawa, Japan

[21] Appl. No.: 395,389

[22] Filed: Aug. 18, 1989

[30] Foreign Application Priority Data

Aug. 19, 1988 [JP] Japan ..... 63-205937

[51] Int. Cl.[5] ..... G03C 1/72

[52] U.S. Cl. ..... 430/138; 430/338; 430/906; 430/909; 430/340; 503/214; 428/402.22; 428/402.24

[58] Field of Search ..... 430/138, 338, 906, 909, 430/340; 503/214, 215; 428/402.22, 402.24

[56] References Cited

U.S. PATENT DOCUMENTS

| | | | |
|---|---|---|---|
| 3,544,321 | 12/1970 | Yamada et al. | 430/337 |
| 3,658,543 | 4/1972 | Gerlach, Jr. et al. | 430/343 |
| 4,223,060 | 9/1980 | Raine et al. | 428/402.22 |
| 4,311,750 | 1/1982 | Kubo et al. | 503/214 |
| 4,423,139 | 12/1983 | Isbrendt et al. | 430/340 |
| 4,857,438 | 8/1989 | Loerzer et al. | 430/920 |
| 4,898,849 | 2/1990 | Kang | 503/214 |
| 4,940,647 | 7/1990 | Frommeld et al. | 430/915 |
| 4,942,107 | 7/1990 | Saeki et al. | 430/138 |

FOREIGN PATENT DOCUMENTS

| | | |
|---|---|---|
| 57-189889 | 11/1982 | Japan . |
| 61-014986 | 1/1986 | Japan . |

OTHER PUBLICATIONS

Copending Application 07/257580 filed on Oct. 14, 1988.

*Primary Examiner*—Marion E. McCamish
*Assistant Examiner*—Christopher D. RoDee
*Attorney, Agent, or Firm*—Sughrue, Mion, Zinn, Macpeak & Seas

[57] ABSTRACT

A light image forming material comprising a support having provided thereon a layer comprising microcapsules containing a leuco dye capable of developing a color through oxidation and a photo oxidizing agent, a reducing agent provided outside the microcapsules, and the layer further comprising carboxy-modified polyvinyl alcohol and epoxidated polyamide resin for imparting high water resistivity.

6 Claims, No Drawings

LIGHT IMAGE FORMING MATERIAL

FIELD OF THE INVENTION

This invention relates to a fixable type light image forming material and, more particularly, to a heat fixable light image forming material of leuco dye type. More specifically, it is concerned with a light image forming material which is so excellent in water resisting property as not to suffer from peeling of coated layers when exposed to or soaked in water even for a long time, and has satisfactory image keeping quality.

BACKGROUND OF THE INVENTION

Light image forming materials can be used in many purposes, for example, as proof paper, print-out paper, overlay film or so on. There have so far been many photographical applications of the so-called free radical photographic materials which have areas visualized by imagewise exposure.

A method which is especially effective in those radical type photographic materials consists in converting various kinds of leuco dyes to their corresponding dyes by the use of photo oxidizing agents, and thereby achieving color development through radical oxidation.

However, since such combinations of leuco dyes with photo oxidizing agents are sensitive to light, color formation occurs by exposure to ordinary room light, sun light or white light even after dye images have been formed by imagewise exposure. Accordingly, there is difficulty in handling light image forming materials of this type.

In order to retain images after they have once been formed, it is necessary to avoid further color development in areas not having been exposed to light at the time of imagewise exposure. For instance, it is known to keep original images by applying a reducing agent solution, such as that of a free radical capturing substance, to the materials having images formed therein by a spraying or a dipping process. However, such a wet process leaves a large question in respect that it is attended by complexities of working and procedures. As another instance, there is a process proposed in JP-A-47-12879 (the term "JP-A" as used herein mean an "unexamined published Japanese patent application") (corresponding to U.S. Pat. No. 3,658,543), wherein images are formed by means of UV rays, and then fixed through activation of photoreducing substances by means of visible light. However, this process also leaves a serious question in that the apparatus is occupied by one image-forming material throughout the light exposure carried out twice, and replacement of one spectral filter with another is required for proper use of two kinds of light. On the other hand, JP-B-43-29407 (the term "JP-B" as used herein means an "examined Japanese patent publication") proposes a process in which a reductive thermofixer is incorporated into or coated on a light-sensitive layer, and thermal fixation is carried out after imagewise exposure. However, this process also has a weighty question that since a light susceptible component (including leuco dyes and photo oxidizing agents) is present in the vicinity of the fixer, a decrease in sensitivity with the lapse of time takes place. In addition, the light image forming compositions described above are coated on a support using an organic solvent, so measures for prevention of explosion are required of the production equipment, and the use of organic solvent causes a further disadvantage in both safety and cost.

With the intention of solving those questions, we have found a fixable type light image forming material in which a combination of a leuco dye and a photo oxidizing agent is contained in microencapsulated condition, and a reducing agent is present o the outside of these microcapsules (see U.S. patent application Ser. No. 07/257,580 filed on Oct. 14, 1988).

However, even the light image forming material of this type has turned out to have a problem that because of insufficient water-resisting property of the light image forming layer, in wiping up water drops attached to the layer surface, the coated layer is likewise wiped off, or the coated layer is easily delaminated by a long-range exposure to water or soaking in water for a long time.

SUMMARY OF THE INVENTION

Therefore, an object of this invention is to provide a heat fixable light image forming material having a light image forming layer excellent in water resisting property.

The above-described object of this invention is attained by a light image forming material comprising a support having provided thereon a layer comprising microcapsules containing a leuco dye capable of developing a color through oxidation and a photo oxidizing agent, a reducing agent provided outside the microcapsules, and the layer further comprising carboxy-modified polyvinyl alcohol and epoxidated polyamide resin for imparting high water resistivity.

DETAILED DESCRIPTION OF THE INVENTION

Carboxy-modified polyvinyl alcohols to be used in this invention are preferably those obtained by saponifying copolymers of vinyl acetate and ethylenic dicarboxylic acids, such as maleic acid, fumaric acid, itaconic acid and the like, as disclosed in JP-A-53-91995. Of such copolymers, those having a carboxy-modified degree of 1 to 10 mol %, a saponification degree of 60 to 99%, and a polymerization degree of 500 to 2,500 are more preferred.

On the other hand, epoxidated polyamide resins to react with the above-described carboxy-modified polyvinyl alcohols to render them insoluble in water are called polyamidopolyamine-epichlorohydrin resin alternatively, and are generally synthesized in the following manner. A diamine containing a secondary amino group in a molecule (e.g., diethylenetriamine) and a dicarboxylic acid (e.g., adipic acid) undergo condensation through dehydration to produce a polyamidopolyamine, and then epichlorohydrin to function as a cross-linking agent in the curing reaction is added to the polyamidopolyamine to form an adduct, and further the pH of the reaction system is shifted to acidic side using hydrochloric acid at the conclusion of the addition reaction, resulting in the production of a cationic polyamidopolyamine-epichlorohydrin resin.

As for the compounding ratio between a carboxy-modified polyvinyl alcohol and an epoxidated polyamide resin, the epoxidated polyamide resin is used in a ratio of 0.5 to 10 parts by weight, preferably 3 to 8 parts by weight, to 10 parts by weight of the carboxy-modified polyvinyl alcohol.

The light image forming layer may optionally contain inorganic or organic pigments, such as kaolin, calcined kaolin, talc, calcium carbonate, noncrystalline silica, hydrophobic silica, barium sulfate, aluminum hydroxide, fine powder of urea-formaline resin, fine powder of polyethylene resin, fine powder of polystyrene resin, etc., waxes such as polyethylene wax, carnauba wax, paraffin wax, microcrystalline wax, fatty acid amides, etc., metal soaps such as zinc stearate, calcium stearate, etc., and surfactants.

For the purpose of further enhancement of water-resisting property, a covering layer may be provided on the light image forming layer. It is desirable that the covering layer should have high adhesiveness to the light image forming layer. In addition, though the covering layer is made up mainly of water-soluble high molecular compounds, it is preferable that the covering layer itself is imparted a water-resisting property by the combined use with other additives.

To such a covering layer as described above, the combination of modified polyvinyl alcohol containing silicon atoms (e.g., a product obtained by saponifying copolymers of silicon atom-containing olefinic unsaturated monomer and vinyl acetate) with colloidal silica and/or noncrystalline silica, or the combination of polyvinyl alcohol with boric acid can be preferably applied. In addition, the combination of carboxy-modified polyvinyl alcohol with epoxidated polyamide resin of this invention can be also preferably applied for the covering layer.

Capsules preferred in this invention are those which can hinder the contact between substances present inside and outside of the capsules owing to the isolating action of the microcapsule wall at ordinary temperatures, and which manifest a mass penetrability or permeability upon heating to some characteristic temperature or higher. A temperature at which substances begin penetrating through the capsule wall can be controlled by properly choosing capsule wall materials, capsule core materials and additives. In this case, the penetration beginning temperature corresponds to the glass transition point of the capsule wall.

In order to control the glass transition point inherent in the capsule wall, appropriate capsule wall forming agents may be selected. Examples of wall materials which can be used in this invention include polyurethane, polyurea, polyamide, polyester, polycarbonate, and so on. Of these materials, polyurethane and polyurea are particularly preferred.

Microcapsules to be used in this invention are prepared by emulsifying a core material which contains light image forming substances including a leuco dye, a photo oxidizing agent and so on, and then forming a wall composed of a high molecular material around the droplets of the emulsified oil. In preparation of the microcapsules, reactants to form the wall are added to the interior and/or the exterior of the oil droplets.

Further details of constructions and preparation of the microcapsules which can be used in this invention is disclosed, for example, in U.S. patent application Ser. No. 07/257,580 filed on Oct. 14, 1988.

As for the organic solvent for dissolution of the above-described light image forming substances, high boiling oils can be used. Suitable examples of such oils include phospholic acid esters, phthalic acid esters, acrylic acid esters, methacrylic acid esters, carboxylic acid esters, fatty acid amides, alkylated biphenyls, alkylated terphenyls, alkylated naphthalenes, diarylethanes, chlorinated paraffin, and so on.

In this invention, an auxiliary solvent with a low boiling point can be added to an organic solvent as described above. Specific examples of such an auxiliary solvent include ethyl acetate, isopropyl acetate, butyl acetate, methylene chloride, cyclohexanone, and so on.

In order to stably form droplets of emulsified oil, a protective colloid and a surfactant can be added to the aqueous phase. As the protective colloid, carboxy-modified polyvinyl alcohol is used to advantage from the standpoint of enhancement of water-resisting property, which is an object of this invention, though in general a water-soluble high molecular compound can be used.

A microcapsule size suitable for this invention is 20 μm or less, preferably 4 μm or less, based on volume average in particular from the standpoints of the heightening of resolution of image and the handling facility.

A leuco dye precursor, referred to herein as a leuco dye, which is one of the components to constitute the light image forming layer of this invention is a reduced form of the corresponding dye, and contains one or two removable hydrogen atoms. It develops a color by the removal of the hydrogen atom(s), or the addition of supplemental electron(s) to form the dye. Since leuco dyes as described above are substantially colorless or slightly colored, they can be employed as means for the pattern formation involving development of their colors by oxidation. In this invention, the oxidation is effected by the presence of at least one photo oxidizing agent. This photo oxidizing agent is activated by the irradiation of light to undergo the reaction with a leuco dye, resulting in the formation of a colored image as compared to the background of the unexposed, and hence unchanged substance.

Leuco dyes which can readily develop their colors through the above-described mechanism include those described, e.g., in U.S. Pat. No. 3,445,234. The leuco dyes described there are the following types of compounds.

(1) Aminotriarylmethanes,
(2) Aminoxanthenes,
(3) Aminothioxanthenes,
(4) Amino-9,10-dihydroacridines,
(5) Aminophenoxazines,
(6) Aminophenothiazines,
(7) Aminodihydrophenazines,
(8) Aminodiphenylmethanes,
(9) Leuco indamines,
(10) Aminohydrocinnamic acids (cyanoethane, leuco methine),
(11) Hydrazines,
(12) Leuco indigoide dyes,
(13) Amino-2,3-dihydroanthraquinones,
(14) Tetrahalo-p,p'-biphenols,
(15) 2-(p-Hydroxyphenyl)-4,5-diphenylimidazoles,
(16) Phenetylanilines.

Of these leuco forms, those belonging to groups (1) to (9) produce their mother dyes by a loss of one hydrogen atom, while those belonging to groups (10) to (16) produce them by a loss of two hydrogen atoms.

More specifically, leuco Crystal Violet, tris(4-diethylamino-o-tolyl)methane, bis(4-diethylamino-o-tolyl)-phenylmethane, bis(4-diethylamino-o-tolyl)thienyl-2-methane, bis(2-chloro-4-diethylaminophenyl)-phenylmethane, 2-(2-chlorophenyl)amino-6-N,N-dibutylamino-9-(2-methoxycarbonyl)phenylxanthene, 2-N,N-dibenzylamino-6-N,N-diethylamino-9-(2-methoxycarbonyl)phenylxanthene, benzo[a]-6-N,N-diethylamino-9-(2-methoxycarbonyl)phenylxanthene, 2-(2-chlorophenyl)amino-6-N,N-dibutylamino-9-(2-methylphenylcarboxamido)phenylxanthene, 3,6-dimethoxy-9-(2-methoxycarbonyl)phenylxanthene, 3,6-diethoxyethyl-9-(2-methoxycarbonyl)phenylxanthene, benzoyl leuco Methylene Blue, 3,7-bisdiethylaminophenoxazine and so on can be given as examples.

Photo oxidizing agents which can be preferably used for the light image forming material of this invention, though normally are inert, produce chemical species to oxidize leuco dyes into their respective colordeveloped forms when exposed to active radiation, such as visible rays, ultraviolet rays, infrared rays, X-rays, etc.

As typical examples of photo oxidizing agents, mention may be made of lophine dimer compounds, such as 2,4,5-triarylimidazole dimers as described in JP-B-62-39728 (corresponding to U.S. Pat. No. 4,247,618) and JP-B-63-2099 (corresponding to U.S. Pat. Nos. 4,311,783 and 4,252,887); azide compounds, such as 2-azidobenzoxazole, benzoylazide and 2-azidobenzimidazole as described in U.S. Pat. No. 3,282,693; pyridinium compounds, such as 3'-ethyl-1-methoxy-2-pyridothiacyanine perchlorate, 1-methoxy-2-methylpyridinium-p-toluenesulfonate, etc., and organic halogen compounds such as N-bromosuccinimide, tribromomethylphenylsulfone, 2-trichloromethyl-5-(p-butoxystyryl)-1,3,4-oxadiazole, 2,6-ditrichloromethyl-4-(p-methoxyphenyl)triazine, etc., as described in U.S. Pat. No. 3,615,568; and azido polymers as described in *Shunki Kenkyu Happyokai Koen Yoshi,* ed. Nippon Shashin Gakkai, page 55 (1968). Of these photo oxidizing agents, lophine dimers and organic halogen compounds are each preferred, and the combined use of both compounds is most suitable since an increase in sensitivity can be achieved.

In preparing the light image forming material of this invention, the leuco dye and the photo oxidizing agent are preferably mixed in a ratio of 10:1 to 1:10 by mole, particularly 2:1 to 1:2 by mole.

The light image forming material of this invention certainly provides stable images by being subjected to a heating treatment after the image formation by optical exposure. More specifically, the fixation mechanism in the light image forming material of this invention is such that the photo oxidizing agent is brought into contact with a reducing agent through a capsule wall by heating, and thereby making them contact with each other to deactivate the photo oxidizing agent through the reaction with the reducing agent even if the photo oxidizing agent is activated by optical exposure after the heat treatment.

Such a reducing agent as described above can trap a free radical of the activated photo oxidizing agent, and functions as a so-called free-radical capturing substance.

Specific examples of reducing agents include hydroquinone compounds and aminophenol compounds as described in U.S. Pat. No. 3,042,515, which each has one hydroxyl group on a benzene ring and further has at least another hydroxyl group or an amino group on another position of the same benzene ring, cyclic phenylhydrazide compounds as described in JP-B-62-39728 (corresponding to U.S. Pat. No. 4,247,618), guanidine derivatives, alkylenediamine derivatives, and hydroxyamine derivatives. These reducing agents can be used alone or as a mixture of two or more thereof. Further, any reducing agent other than the above-described agents can be used in this invention so long as it is a so-called reductive substance and has such a function as to act on an oxidizing agent.

In the light image forming material of this invention, it is appropriate to use a reducing agent as described above in the form of a solid dispersion prepared with a sand mill or the like, or an emulsified dispersion prepared by dissolving the reducing agent in an oil and then emulsifying the resulting oil. Protective colloids which can be used in preparing the solid dispersion or the emulsified dispersion, though generally including water-soluble high molecular compounds, are preferably carboxy-modified polyvinyl alcohols, in analogy with the protective colloid for microencapsulation, for the purpose of the enhancement of water resistivity, that is, for achieving the object of this invention.

An amount of the reducing agent used is preferably 1 to 100 moles, particularly 5 to 20 moles, per mole of the photo oxidizing component.

The combined use of the reducing agent and a melting-point depressant, such as p-benzyloxyphenol or p-toluenesulfonamide, has an advantage in that low temperature fixation becomes feasible.

Although the image fixation in this invention can be effectively achieved by making the photo oxidizing agent and/or the reducing agent pass through the capsule wall by heating to bring them into contact with each other, a synergistic effect can be also expected by simultaneous application of heat and pressure.

In this invention, known sensitizers, ultraviolet absorbents and antioxidants may be added to the inside of the capsules, if desired.

The light image forming material of this ivnention can be produced by coating on a support a composition which is prepared by adding an epoxidated polyamide resin and a carboxy-modified polyvinyl alcohol to a dispersion comprising microcapsules containing a leuco dye and a photo oxidizing agent together, and a reducing agent. In the coated layer, the epoxidated polyamide resin undergoes a reaction with the carboxy-modified polyvinyl alcohol to produce a substance slightly soluble or insoluble in water. Owning to this product, water resistivity of the coated layer as a whole is supposed to be enhanced.

In order to impart sufficient water resistivity to the light image forming material, which is the object of this invention, the carboxy-modified polyvinyl alcohol and the epoxidated polyvinyl alcohol are added in a total proportion of 1 to 50 wt %, preferably 5 to 35 wt %, and more preferably 10 to 25 wt %, to the whole solids to be used.

A preferred coverage of the light image forming composition is from 3 to 30 g/m$^2$, particularly from 5 to 20 g/m$^2$, based on the solids.

Materials suitable for the support include various sorts of paper such as tissue paper or cardboard, and films of regenerated cellulose, cellulose acetate, cellulose nitrate, polyethylene terephthalate, polyethylene, polyvinyl acetate, polymethylmethacrylate, polyvinyl chloride and so on.

As examples of methods suitable for coating the light image forming composition on the support, mention may be made of an air knife coating method, a curtain coating method, a slide coating method, a roller coating method, a dip coating method, a wire-bar coating method, a blade coating method, a gravure coating method, a spin coating method, an extrusion coating method, and so on. However, coating methods other than the above-cited ones may be employed in this invention.

Any convenient light source can be used for activation of photo oxidizing agents and image formation from leuco dyes in this invention. Usual light sources include a fluorescent lamp, a mercury lamp, a metal halide lamp, a xenon lamp, a tungsten lamp, and so on.

The light image forming material of this invention is used as a light image forming composition excellent in water resisting property. This invention will now be illustrated in more detail by reference to the following example and comparative examples. However, the invention should not be construed as being limited to this example. Additionally, all parts indicating the amounts added are by weight unless otherwise noted.

EXAMPLE 1

To a solvent mixture of 22 parts of methylene chloride and 24 parts of tricresyl phosphate, 3 parts of leuco Crystal Violet, 3 parts of 2,2'-bis(o-chlorophenyl)4,4'5,5'-tetraphenylbiimidazole, 0.6 parts of tribromomethylphenylsulfone, 0.4 part of 2,5-di-t-octylhydroquinone and 24 parts of a 75 wt % ethyl acetate solution of xylylenediisocyanate/trimethylol propane adduct were added to make them into a solution. This solution was added to 63 parts of an 8 wt % aqueous solution of carboxy-modified polyvinyl alcohol, and dispersed thereinto at 20° C. in the form of emulsion with an average droplet size of 1 μm. The thus obtained emulsion was added to 100 parts of water, and stirred for 3 hours at 40° C. After the emulsion temperature is returned to room temperature, the emulsion was filtered to prepare a capsule dispersion.

Then, 30 parts of 1-phenylpyrazolidine-3-one (phenidone A) was added to 150 parts of a 4 wt % of carboxy-modified polyvinyl alcohol, and dispersed thereinto with a horizontal type sand mill to prepare a phenidone A dispersion with an average particle size of 1 μm.

Further, a coating composition containing the following amounts of ingredients was prepared.

| | |
|---|---|
| The above-described capsule dispersion | 240 parts |
| The above-described phenidone A dispersion | 180 parts |
| 20% Dispersion of silica (syloide 404, produced by Fuji Devison Chemical Industry Co., Ltd.) | 20 parts |
| 30% Epoxidated polyamide resin (FL-71, produced by Toho Kagaku K.K.) | 15 parts |
| 3% Aqueous solution of polyethylene glycollauryl ether | 10 parts |

This coating composition was coated on wood free paper (basis weight: 76 g/m$^2$) at a coverage of 10 g/m$^2$ on the solids basis, and dried at 50° C. to prepare a light image forming material.

COMPARATIVE EXAMPLE 1

Another light image forming material was prepared in the same manner as in Example 1, except carboxy-unmodified polyvinyl alcohol (PVA 217, produced by Kuraray Co., Ltd.) was incorporated into the light image forming layer instead of the carboxy-modified polyvinyl alcohol.

The light image forming materials prepared in Example 1 and Comparative Example 1 were submitted to the following tests. The results obtained are shown in Table 1.

(1) Image Density:

Fresh samples were each exposed to light through a line original by means of a jet light (an ultra high pressure mercury lamp, produced by Oak Co., Ltd.), and the image density in the exposed area was measured with a Macbeth reflection densitometer.

(2) Thermal Fixability:

The above-described, imagewise exposed samples were each passed between two rolls heated to 120° C. at a speed of 450 mm/min, and thereafter they were again exposed to the jet light. Thereupon, observation was made as to whether the image was changed or not.

(3) Peeling of Coated Layer:

The samples which had finished the above-described thermal fixation were soaked in water for 5 minutes. Then, they were taken out, and each was rubbed with fingers as it was in a wet condition. Thereupon, occurrence of peeling was observed.

TABLE 1

| | Image Density | Thermal Fixability | Peeling of Coated Layer |
|---|---|---|---|
| Example 1 | 1.26 | good | scarcely observed |
| Comparative Example 1 | 1.28 | good | markedly observed |

COMPARATIVE EXAMPLE 2

Still another light image forming material was prepared in the same manner as in Example 1, except the epoxidated polyamide resin incorporated in the light image forming layer of Example 1 was not used. This sample was also evaluated by the above-described tests to obtain results similar to those in Comparative Example 1.

The light image forming material prepared in accordance with this invention is equal in image density and thermal fixability, and superior in water resistivity to light image forming materials in which both carboxy-modified polyvinyl alcohol and epoxidated polyamide resin are not incorporated.

While the invention has been described in detail and with reference to specific embodiments thereof, it will be apparent to one of ordinary skill in the art that various changes and modifications can be made therein without departing from the spirit and scope thereof.

What is claimed is:

1. A light image forming material comprising a support having provided thereon a layer comprising microcapsules containing a leuco dye capable of developing a color through oxidation and a photo oxidizing agent, a reducing agent provided outside said microcapsules, and said layer further comprising carboxy-modified polyvinyl alcohol and epoxidated polyamide resin.

2. A light image forming material as claimed in claim 1, wherein said carboxy-modified polyvinyl alcohol is obtained by saponifying copolymers of vinyl acetate and ethylenic dicarboxylic acids.

3. A light image forming material as claimed in claim 2, wherein said copolymers upon saponification have a carboxy-modified degree of 1 to 10 mol %, a saponification degree of 60 to 99%, and a polymerization degree of 500 to 2,500.

4. A light image forming material as claimed in claim 1, wherein said epoxidated polyamide resin is a cationic polyamidopolyamine-epichlorohydrin resin.

5. A light image forming material as claimed in claim 1, wherein said carboxy-modified polyvinyl alcohol and epoxydated polyamide resin are reacted to form a slightly water soluble or a water insoluble product.

6. A light image forming material as claimed in claim 1, wherein the ratio of epoxidated polyamide resin to carboxy-modified polyvinyl alcohol is 0.5 to 10 parts by weight of epoxidated polyamide resin to 10 parts by weight of carboxy-modified polyvinyl alcohol.

* * * * *